United States Patent [19]

Drogo

[11] Patent Number: 4,900,260

[45] Date of Patent: Feb. 13, 1990

[54] ELECTRICAL CONDUCTOR

[76] Inventor: Pierre L. M. Drogo, Le Verdier Dampierre en Burly, 45570 Ouzouer Sur Loire, France

[21] Appl. No.: 228,299

[22] Filed: Aug. 4, 1988

Related U.S. Application Data

[63] Continuation of Ser. No. 37,692, Apr. 13, 1987, abandoned.

[30] Foreign Application Priority Data

Apr. 11, 1986 [FR] France ..... 86 05203

[51] Int. Cl.[4] ..... H01R 4/38

[52] U.S. Cl. ..... 439/321; 439/339; 439/310

[58] Field of Search ..... 439/312–321, 439/339, 310

[56] References Cited

U.S. PATENT DOCUMENTS

| | | | |
|---|---|---|---|
| 3,576,517 | 4/1971 | Johnson et al. | 439/321 |
| 3,786,396 | 1/1974 | Kemmer et al. | 439/321 |
| 4,290,662 | 9/1981 | Stoicel | 439/320 |
| 4,322,121 | 3/1982 | Riches et al. | 439/312 |
| 4,508,407 | 4/1985 | Ball | 439/312 |
| 4,534,607 | 8/1985 | Tomsa | 439/312 |
| 4,639,064 | 1/1987 | Knapp et al. | 439/318 |

*Primary Examiner*—David Pirlot
*Attorney, Agent, or Firm*—Clifford A. Poff

[57] ABSTRACT

Electrical connector characterized in that the plug body (4) and the coupling nut (10) comprise in one case a circular alignment of catches (12), and in the other an axially movable ring (13) provided with at least one complementary catch referred to as a dog (14) oriented towards the alignment of catches, elastic means (15, 16) being provided to co-operate with the ring (13) and, in a position of nonassembly of the connector, to maintain the dog apart from the alignment of catches, the ring and the elastic means being disposed in the path of the body of the coupling connector (3) so that the coupling connector body pushes the dog resiliently between the catches when assembly of the connector is completed.

6 Claims, 1 Drawing Sheet

ELECTRICAL CONDUCTOR

This is a continuation of co-pending application Ser. No. 037,692 filed on Apr. 13, 1987 now abandoned.

The invention relates to an electrical connector.

Generally speaking, electrical connectors are composed of a coupling and a plug on which is mounted a freely rotatable coupling nut.

The plug and the coupling are each composed of a generally cylindrical metal body inside which there is an insert of insulating material which receives the male or female connecting pins. The plug body and the coupling body are each provided with complementary longitudinal grooves designed to ensure angular positioning of the plug in relation to the coupling when assembled and to ensure that each male pin is assembled together with its corresponding female pin.

Assembly of the plug on the coupling is achieved by turning a screwthread provided on the inside face of the coupling nut so that it engages a complementary screwthread provided on the outer face of the coupling.

One of the drawbacks of these couplings resides in the fact that the coupling nut can become unscrewed from the coupling when the coupling is subject to vibrations, resulting in accidental separation of the plug.

To remedy these drawbacks, then, provision has been made in known connectors for an elastic locking device to be positioned between the coupling nut and the coupling body so that the catches arrest rotation of the coupling nut on the plug and so prevent their becoming unscrewed.

However, although this known construction is effective in avoiding unexpected unscrewing of the coupling nut, it does nevertheless have various drawbacks, particularly is that handling of the coupling nut is unpleasant due to the fact that the catches act throughout the entire period while the coupling nut is rotating on the plug. Furthermore, due to the fact that this locking means exists throughout the entire rotation of the coupling nut, the locking position is ill-defined due to an excessive number of click stop positions of the coupling nut, although the operator can arrest screwing of the coupling nut while the plug is not completely introduced into the coupling or, on the contrary, the operator may force the screwing of the coupling nut after the plug has already been completely inserted into the coupling.

Likewise, the prior art connector leaves a measure of uncertainty concerning complete screwing of the coupling nut onto the coupling and, for example, if there is subsequently a foreign body (earth or sand) between the plug and the coupling or between the plug and the coupling nut, fitment of the plug onto the coupling may be prevented and the operator may cease to screw the coupling nut although the plug is incorrectly or incompletely fitted into the coupling, the consequence being serious deficiencies in the electrical connections which would be difficult to monitor.

It is a particular object of the present invention to remedy these drawbacks and to this end it relates to an electrical connector comprising a coupling and a plug, composed of a coupling body and a plug body each of which accommodates an insert of insulating material, one provided with male pins, the other with female connecting pins, matching grooves and ribs on the bodies of the plug and of the coupling being provided for correct angular positioning when these parts are assembled by axial displacement, a coupling nut mounted to rotate on a shoulder of the plug body, the coupling nut being provided with a screwthread which, when the connector is assembled, engages a corresponding screwthread on the coupling body, locking means being provided between the coupling nut and the plug body to limit rotation of the former and to prevent its becoming unexpectedly unscrewed from the coupling body, the connector being characterised in that the plug body and the coupling nut comprise in one case a circular alignment of catches, the other an axially movable ring provided with at least one complementary catch referred to as a dog which is orientated towards the alignment of catches, elastic means being provided to cooperate with the ring and, in the non-assembled position of the connector, to maintain the dog away from the alignment of catches, the said ring and the said elastic means being disposed on the path of the coupling body so that upon completion of assembly, the dog is pushed back elastically between the catches.

According to another feature of the invention, the ring is disposed axially between two elastic means.

According to another characteristic of the invention, the alignment of catches is provided on an inner returned edge on the coupling nut, while the ring and the elastic means are disposed on the plug body so that the coupling body is capable of pushing the dog back towards the catches when assembly of the connector is completed.

According to another characteristic feature of the invention, the alignment of the catches provided on the inner returned edge of the coupling nut on the one hand and the ring as well as the elastic means mounted on the plug body, on the other, are disposed on either side of the shoulder of the plug body, the dog being permanently maintained in a notch in the shoulder of the plug body.

According to another characteristic feature of the invention, the alignment of catches on the one hand and the dog on the other are provided opposite each other, one on the shoulder of the plug body, the other on an axially movable ring provided on the coupling nut between two elastic means to be situated in the path of the coupling body when the connector is assembled.

The invention is illustrated by way of non-limitative example in the accompanying drawings, in which.

Consequently, the present invention has as its object the provision of a connector which is pleasant to manipulate, which makes it possible to show the assembled position of the connector and which likewise makes it possible to avoid the two parts of the connector becoming separate when they are subjected to vibrations.

Figure 1:
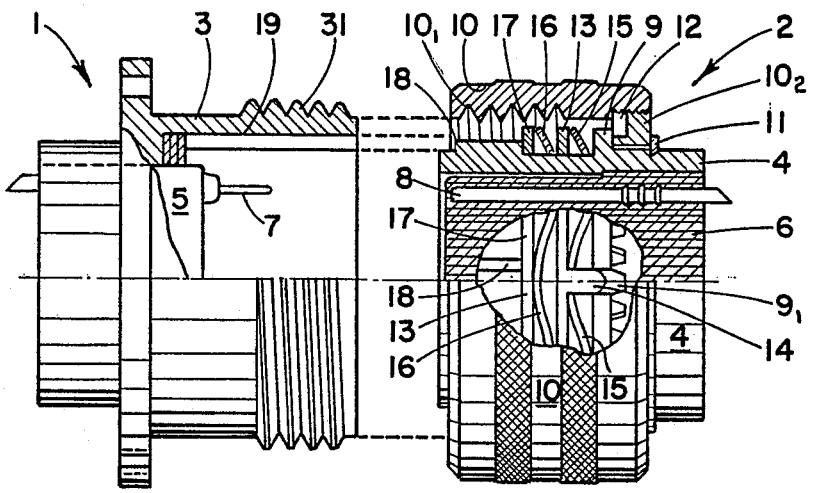
FIG. 1 is a semi-cross-sectional view with part torn away showing the coupling and the plug of a connector, the said coupling and the said plug being shown in disassembled positions.
Figure 2:
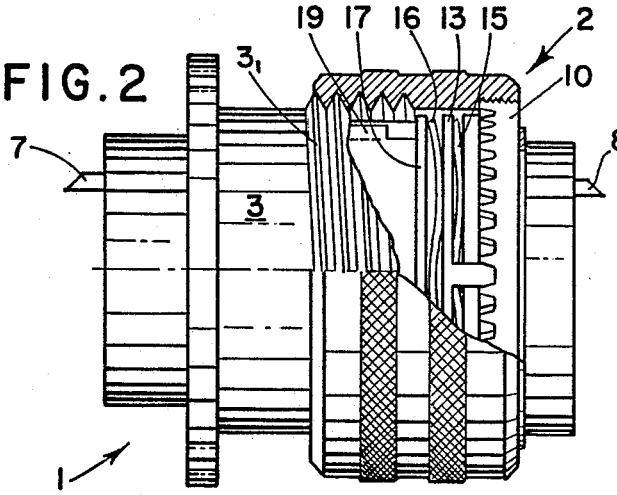
FIG. 2 is a semi-cross-sectional view with part torn away showing the connector in FIG. 1 in an assembled position.

According to the embodiment shown in FIGS. 1 and 2, the connector comprises a coupling 1 and a plug 2.

The coupling and the plug each comprise a coupling body 3 and a plug body 4, both preferably of metal, inside which is housed an insert of insulating material, respectively 5 and 6, one of the inserts being provided with male pins 7, the other with female connecting pins 8.

The plug body 4 comprises a shoulder 9 against which a coupling nut 10 is mounted for free rotation, being provided with an inner screwthread $10_1$ co-operating with a screwthread $3_1$ provided on the coupling body 3.

The coupling nut 10 bears on the shoulder 9 through the intermediary of a rebated member $10_2$ fixed to the coupling nut by screwing, crimping or any other means. The coupling nut 10 is maintained on the plug body 4 between the shoulder 9 and a split resilient washer 11 accommodated in a groove.

Figure 5:
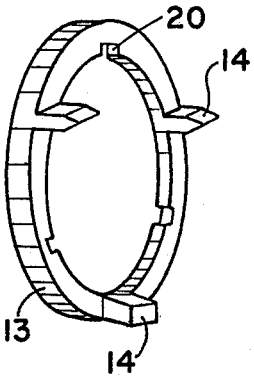

This rebated portion $10_2$ fixed to the coupling nut 10 is of hard metal and comprises a circular alignment of catches 12. Furthermore, the plug body 4 comprises a ring 13 (see also FIG. 5) which is provided with three dogs 14 orientated towards the circular alignment of catches 12.

The dogs 14 are each housed to slide freely in a notch $9_1$ in the shoulder 9 so that the end of these dogs is able to be housed between the catches of the alignment of catches 12.

Figure 4:
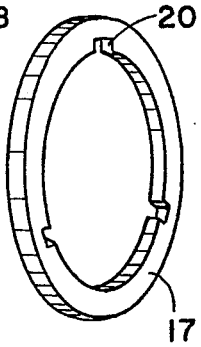
FIGS. 4 and 5 show in perspective the rings used in the connector shown in FIGS. 1, 2 and 3.

The ring 13 is disposed between two undulating spring metal washers 15 and 16, the washer 15 being disposed between the ring 13 and the shoulder 9, and the other washer 16 being disposed between the ring 13 and a second ring 17 (see also FIG. 4).

The plug body 4 comprises on its outer face longitudinal ribs 18 which correspond with grooves 19 formed on the inner wall of the plug body 3, these grooves and ribs forming foolproof keyways for axial assembly of the plug body 4 on the coupling body 3 in one single angular position in which each male pin 7 is disposed in the axis of its female pin 8.

To allow fitment of the rings 13, 17, these latter comprise notches 20 corresponding in number, position and dimensions to those of the ribs 18. After positioning of the rings and washers 15, 16 on the plug body beyond the ribs 18, the washers 13, 17 are turned in order that the notches 10 can be offset angularly from the ribs 18, so avoiding unexpected emergence of the stack of rings and washers from the top of the plug body.

Furthermore, preferably, the offset of the dogs 14 and notches 20 in the ring 13 will differ from the offset of the notches $9_1$ and ribs 18, in order certainly to avoid the notches 20 being positioned in the alignment of the ribs 18 when the dogs 14 are disposed in the notches $9_1$ in the shoulder 9.

Likewise, for reasons which will be stipulated hereinafter, the spring washer 15 is preferably less strong than the washer 16.

In the construction described, the stack of rings and washers 13, 15, 16, 17 which projects outside the grooves 19 is disposed in the path of the coupling body 3 when the connector is assembled. Thus, when the plug is assembled together with the coupling, the ribs 18 are first of all introduced into the grooves 19 and then the plug body is displaced axially towards the coupling body, while the screwthread $10_1$ of the coupling nut 10 co-operates with the screwthread $3_1$ of the coupling body 3. During this screwing operation, the male pins 7 penetrate the female pins 8 then the free end of the coupling body 3 bears on the ring 17 to push back the assembly of the two rings 16, 17 and the two washers 15, 16 towards the shoulder 9 so that the dogs 14 are caused to slide in the notches $9_1$ and towards the catches 12. During these displacements of the rings and washers, due to the relative axial displacement of the plug body and of the coupling body, the washer 15 becomes compressed since it offers less elastic force than the washer 16, then upon completion of screwing of the coupling nut on the coupling body, the ends of the dogs 14 penetrate between the catches of the alignment of catches 12 so that final rotation of the coupling nut 10 to produce completion of screwing and completion of assembly of the plug on the connector is felt by the operator both mechanically and auditively.

Indeed, when the dogs 14 penetrate between the catches 12, rotation of the coupling nut 10 can be continued only by extraction of the dogs 14 from these catches, against the washer 16, which means an increased localised resistance to rotation of the coupling nut and by an audible clicking sound, this increased resistance and this audible clicking sound increasing as final assembly approaches, that is to say as the spring washer 16 itself tends to be compressed by insertion of the plug body 4 into the coupling body 3.

The dimensions of the catches, dogs and springs might, for example, be determined in such a way that, upon completion of assembly, there are four mechanical and audible clicking sounds of increasing force which thus demonstrate perfectly well that the connector has been correctly assembled, the co-operation of the dogs and catches making it possible furthermore to avoid any unexpected unscrewing of the coupling nut 10 due to vibration and therefore separation of the plug from the coupling.

In the present description, it is stated that the plug body and the coupling nut comprise in one case an alignment of catches and in the other at least one dog. It will however be noted that different terms "catch" and "dog" are used only for reasons of terminology because the catches and the dogs may be replaced by each other, the connector likewise being capable of having two circular alignments of catches.

And so, in the example shown in FIGS. 1 and 2, the ring 13 could comprise an outer ring provided with catches, adapted to pass over the shoulder 9 in order to engage dogs (or catches) 12. In this case, the said axially movable ring 13 will be rotationally immobilised by complementary ribs and grooves provided in the plug body.

Similarly, in the embodiment shown in FIGS. 1 and 2, the axially movable ring 13 is mounted on the plug body while the circular alignment of catches (or dogs) is provided on the coupling nut.

Figure 3:
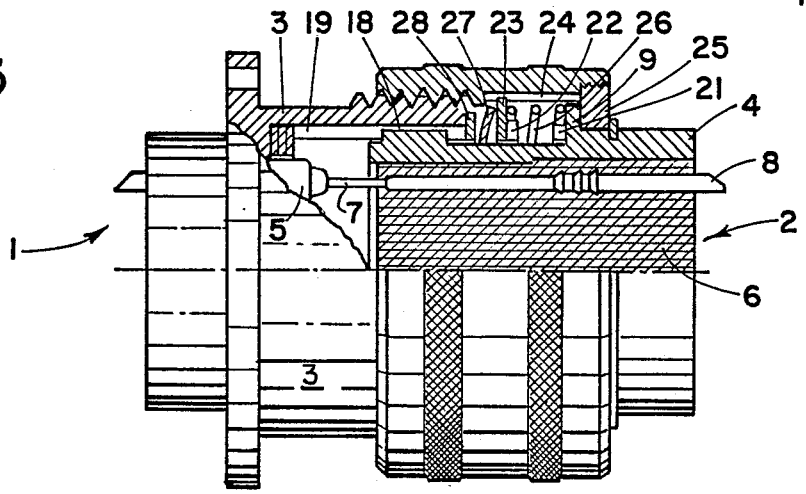
FIG. 3 shows in a semi-section with part torn away, showing another embodiment of connector, this connector being represented in the position in which it is when assembly of the plug on the coupling is commenced.

However, a reverse arrangement could be provided as is shown in FIG. 3.

In this case, the shoulder 9 of the coupling comprises dogs or a circular alignment of catches 21 disposed opposite a circular alignment of catches (or dogs) 22 provided facing it on a ring 23.

This ring 23 comprises on its periphery notches which are housed on ribs 24 provided on the inner face of the coupling nut 10 so that the said ring 23 can move axially in relation to the coupling nut although it is immobilised in a rotational sense. In this case, and having regard to the method of construction adopted, the coupling nut 10 comprises an inner end rebate 25 which is fixed, for examples by being screwed so as to allow positioning of the ring 23 on the ribs 24.

The ring 23 is disposed between two elastic means which in this example consist of a return spring 26 disposed between the shoulder 9 and the ring 23 and by an undulating spring steel washer 27 disposed between the ring 23 and a second ring 28 adapted to receive and act as a bearing surface for the end of the coupling body 3. This second ring 27 may be mounted either on the coupling nut 10 or on the ring 23 or on the plug body 4, like the ring 17 in the embodiment shown in FIGS. 1 and 2.

This connector functions in a manner similar to that of FIGS. 1 and 2 and it is found that during screwing of the coupling nut 10 for axial insertion of the plug body 4 into the coupling body 3 and for electrical connection of the male and female pins, the end of the coupling body 3 bears on the ring 27 in order first of all to push back the ring 23 towards the shoulder 9 and against the spring 26. When the return spring 26, which is weaker than the spring 27, is compressed, the dogs and catches 21 and 22 engage one with the other upon completion of assembly of the connector and rotation of the coupling nut 10 then continues, producing mechanical and audible and increasing clicking noises according to compression of the spring 27 by the coupling 3.

We claim:

1. An electrical connector comprising:

a coupling including a coupling body having a shoulder with an electrically insulative insert therein;

a plug each including a plug body and an electrically insulative insert therein;

male convertor pins provided in the electrically insulative insert for one of said coupling body and said plug body and female connector pins provided in the other insert;

complementary ribs and grooves on said coupling and plug body to permit relatively axial displacement when angularly positioned;

a threaded coupling nut rotatably mounted on said shoulder of the coupling nut for threadedly engaging complementary threads on the coupling body;

locking means between said coupling nut and said plug for limiting threaded advancement of the coupling nut along threads of the coupling body and preventing unexpectedly unthreading thereof, said locking means including a ring having at least one dog forming a catch orientated and complementary to a circular alignment of catches, said ring being axially movable on said plug body; and elastic means including two elastic members at opposite sides of said ring, one elastic member urging said dog away from engagement with said catches before the coupling and plug are connected, said elastic members and said ring being disposed in the path of travel of the coupling body when connecting the coupling and plug, the other elastic member elastically pushing the dog between said catches.

2. The electrical connector according to claim 1 wherein said axially movably ring and catches comprise materials different from the materials comprising said plug body and coupling body.

3. The electrical connector according to claim 1 wherein said catches and said dog are provided opposite each other and one of which is provided on said shoulder and the other is on said ring on said coupling nut between said two elastic members at a site situated along a path of travel by the coupling body when the coupling and plug are assembled.

4. The electrical connector according to claim 1 wherein said threaded coupling nut includes an inner rebate containing said catches and wherein said ring and elastic means are disposed on said plug body for movement of the dog by the coupling body towards said catches when connecting the coupling and the plug.

5. The electrical connector according to claim 4 wherein said catches are disposed on one side of said shoulder and said ring and elastic means are disposed on the other side of said shoulder, and wherein said dog is maintained in a notch in said shoulder.

6. The electrical connector according to claim 5 wherein said electrical connector further including a second ring disposed between said coupling body and the elastic members for contact with said coupling body.

* * * * *